US005915907A

United States Patent [19]

Yatou et al.

[11] Patent Number: 5,915,907

[45] Date of Patent: Jun. 29, 1999

[54] APPARATUS FOR TURNING ARTICLES IN STORAGE STRUCTURES

[75] Inventors: Katsuyoshi Yatou, Gifu; Wakao Mamiya, Minokamo, both of Japan

[73] Assignee: Fuji Hensokuki Co., Ltd., Gifu-ken, Japan

[21] Appl. No.: 08/909,122

[22] Filed: Aug. 11, 1997

[30] Foreign Application Priority Data

Aug. 19, 1996 [JP] Japan ..... 8-253679
Apr. 15, 1997 [JP] Japan ..... 9-097304

[51] Int. Cl.[6] ..... E04H 6/18

[52] U.S. Cl. ..... 414/254; 104/44; 104/46; 414/255; 414/282; 414/261; 414/260

[58] Field of Search ..... 414/800, 227, 414/241, 245, 246, 247, 249, 253, 255, 254, 257, 256, 259, 260, 261, 262, 263, 264, 790, 281, 282, 286; 104/44, 46, 35

[56] References Cited

U.S. PATENT DOCUMENTS

| | | | |
|---|---|---|---|
| 3,161,303 | 12/1964 | Burrows | 414/254 |
| 3,204,785 | 9/1965 | Bajulaz | 414/254 |
| 3,896,955 | 7/1975 | Collins et al. | 414/254 |
| 5,116,182 | 5/1992 | Lin | 414/254 |

FOREIGN PATENT DOCUMENTS

| | | | |
|---|---|---|---|
| 219263 | 9/1989 | Japan | 414/254 |
| 176078 | 7/1990 | Japan | 414/254 |
| 39572 | 2/1991 | Japan | 414/254 |
| 228974 | 10/1991 | Japan | 414/254 |
| 33251 | 2/1993 | Japan | 414/254 |
| 5-149017 | 9/1993 | Japan . | |
| 6-108688 | 7/1994 | Japan . | |
| 07042399 | 2/1995 | Japan . | |
| 8-060887 | 3/1996 | Japan . | |
| WO91/12397 | 8/1991 | WIPO | 414/254 |

*Primary Examiner*—Frank E. Werner
*Attorney, Agent, or Firm*—D. Peter Hochberg

[57] ABSTRACT

A storage structure has an entry chamber for receiving articles, a storage area for storing the articles, a lift passage for connecting the entry chamber and the storage area, and a lift for conveying the articles through the lift passage between the entry chamber and the storage area. The storage structure includes a turning chamber provided separately from the entry chamber and connected to the lift passage for changing the orientation of an article. A turntable device is supported in the turning chamber to receive an article from the lift within the lift passage and to transfer an article to the lift. The turntable device includes a rotatable carrying surface and two auxiliary supports. One auxiliary support is located on each of two opposite sides of the turntable device for supporting the carrying surface when the carrying surface rotates. The carrying surface is movable between a position within the lift passage and a position outside of the lift passage.

20 Claims, 11 Drawing Sheets

APPARATUS FOR TURNING ARTICLES IN STORAGE STRUCTURES

BACKGROUND OF THE INVENTION

The present invention relates to storage structures such as parking structures, and more particularly, to apparatuses for turning stored articles, such as motor vehicles.

A typical parking structure (e.g., Japanese Unexamined Patent Publication No. 8-60887) includes an entry station, storing compartments, elevator shaft, and elevator. The entry station is where the cars enter and exit the parking structure and is located on the ground level. The storing compartments are used to store the cars and are located on floors above the ground level or floors underground. The elevator shaft connects the entry station and the storing compartments. The elevator travels through the elevator shaft to carry the cars between the entry station and the storing compartments.

The elevator includes a comb-like lifting platform to carry cars through the elevator shaft. The platform is lifted or lowered in the elevator shaft while carrying cars. A turntable having a comb-like carrying portion is arranged on a movable center tray provided in the entry station. In the entry station, the turntable is rotated to shift its carrying portion between a first position, at which cars are transferred between the carrying portion and the platform, and a loading position, at which cars may enter and exit the parking structure. The turntable also functions as an apparatus for turning cars so that they may always be driven in a forward direction when entering and exiting the parking structure.

However, to stabilize rotation of the turntable, especially when carrying a car, a main rail must be provided on the movable center tray to support the turntable during rotation especially when carrying a car. A pair of auxiliary rails must also be provided on opposite sides of the turntable. Furthermore, when lowering the platform of the elevator below ground level, the center tray, the turntable, and the auxiliary rails must be moved away from the center portion of the entry station.

Therefore, in the prior art, the movable center tray is separate from the pair of auxiliary rails. When lowering the platform, the movable center tray, the turntable, and one of the auxiliary rails are moved to one side of the entry station. This structure reduces the space required to permit the lowering of the platform. However, a large space must be provided in the entry station to accommodate the turntable.

SUMMARY OF THE INVENTION

Accordingly, it is an objective of the present invention to save space in the entry station by arranging the turning apparatus outside the entry station. To achieve the above objective, the present invention provides a storage structure having an entry chamber for receiving articles, a storage area for storing the articles, a lift passage for connecting the entry chamber and the storage area, and a lift for conveying the articles through the lift passage between the entry chamber and the storage area. The storage structure includes a turning chamber provided separately from the entry chamber and connected to the lift passage for changing the orientation of an article. A turntable device is supported in the turning chamber to receive an article from the lift within the lift passage and to transfer an article to the lift. The turntable device includes a rotatable carrying surface and two auxiliary supports. One auxiliary support is located on each of two opposite sides of the turntable device for supporting the carrying surface when the carrying surface rotates. The carrying surface is movable between a position within the lift passage and a position outside of the lift passage.

Other aspects and advantages of the present invention will become apparent from the following description taken in conjunction with the accompanying drawings, illustrating by way of example the principals of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a parking structure serving as a storage structure according to the present invention will now be described with reference to FIGS. 1 to 6.

Figure 1:
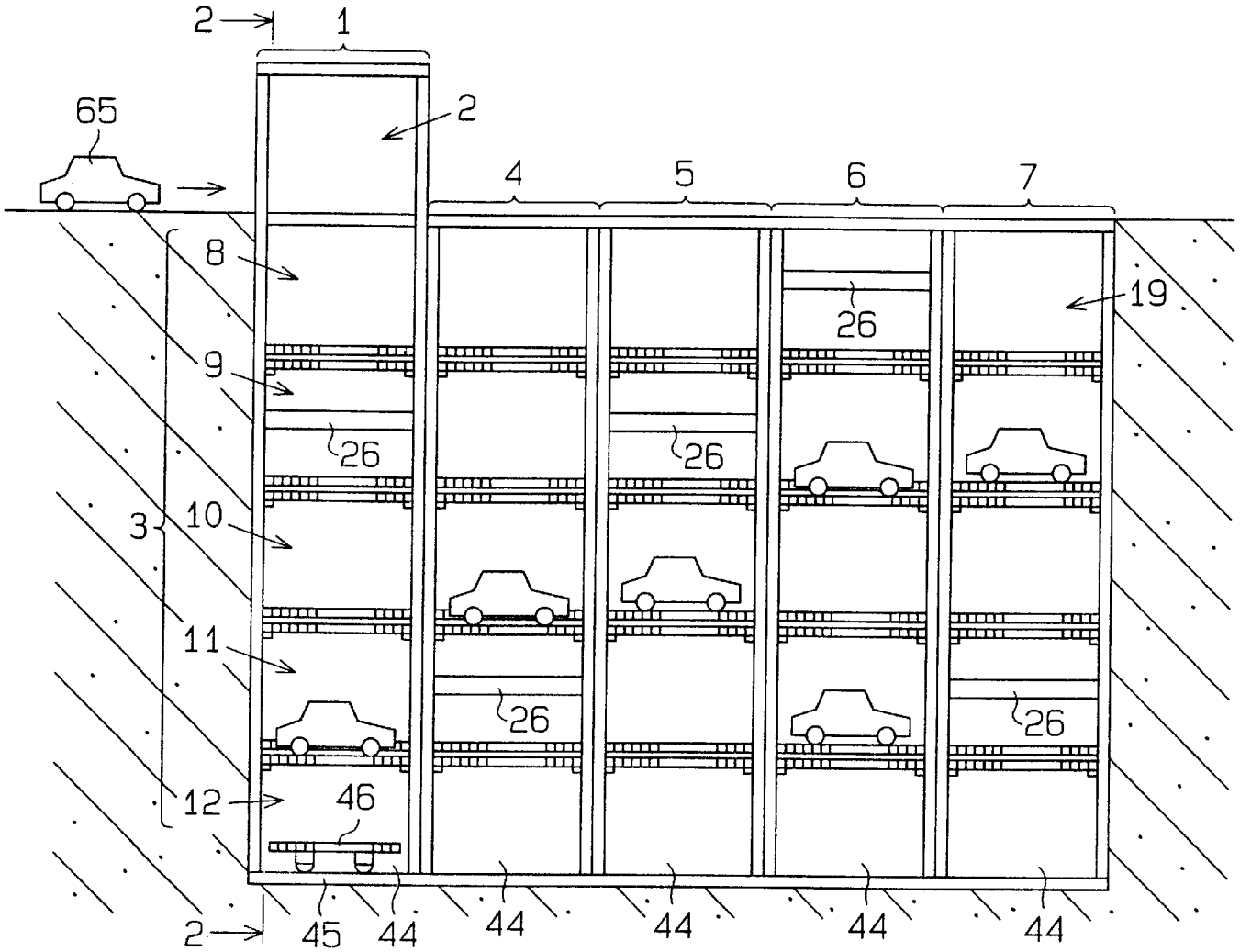
FIG. 1 is a schematic cross-sectional view showing a parking structure according to a first embodiment of the present invention.

An underground parking structure having first, second, third, fourth, and fifth storage blocks 1, 4, 5, 6, 7 is shown in FIG. 1. The first storage block 1 includes an entry station 2 located on the ground level, or the uppermost level, and an underground storage area 3 (refer to FIG. 2). The second, third, fourth, and fifth storage blocks 4, 5, 6, 7 are arranged in a row with the first storage block 1.

A turning area 8 (also serving as a car storing section) is defined at basement level one of the first storage block 1. Car storing sections 9, 10, 11 are defined at basement levels two, three, and four, respectively. A transferring section 12 is defined at basement level five (the lowermost level) of the first, second, third, fourth, and fifth storage blocks 1, 4, 5, 6, 7. Four guide rails 13, 14, 15, 16 having a predetermined distance between one another extend vertically between the entry station 2 and the transferring section 12 (refer to FIGS. 3 and 4).

The space between the guide rails 13, 14, 15, 16 extending through the entry station 2, the turning area 8, the storing sections 9, 10, 11, and the transferring section 12 define a lift passage, or an elevator shaft 17. Storing compartments 18 are provided on each side of the elevator shaft 17 in the turning area 8 and the storing sections 9, 10, 11. The entry station 2 is connected with each storing compartment 18 through the elevator shaft 17.

Figure 2:
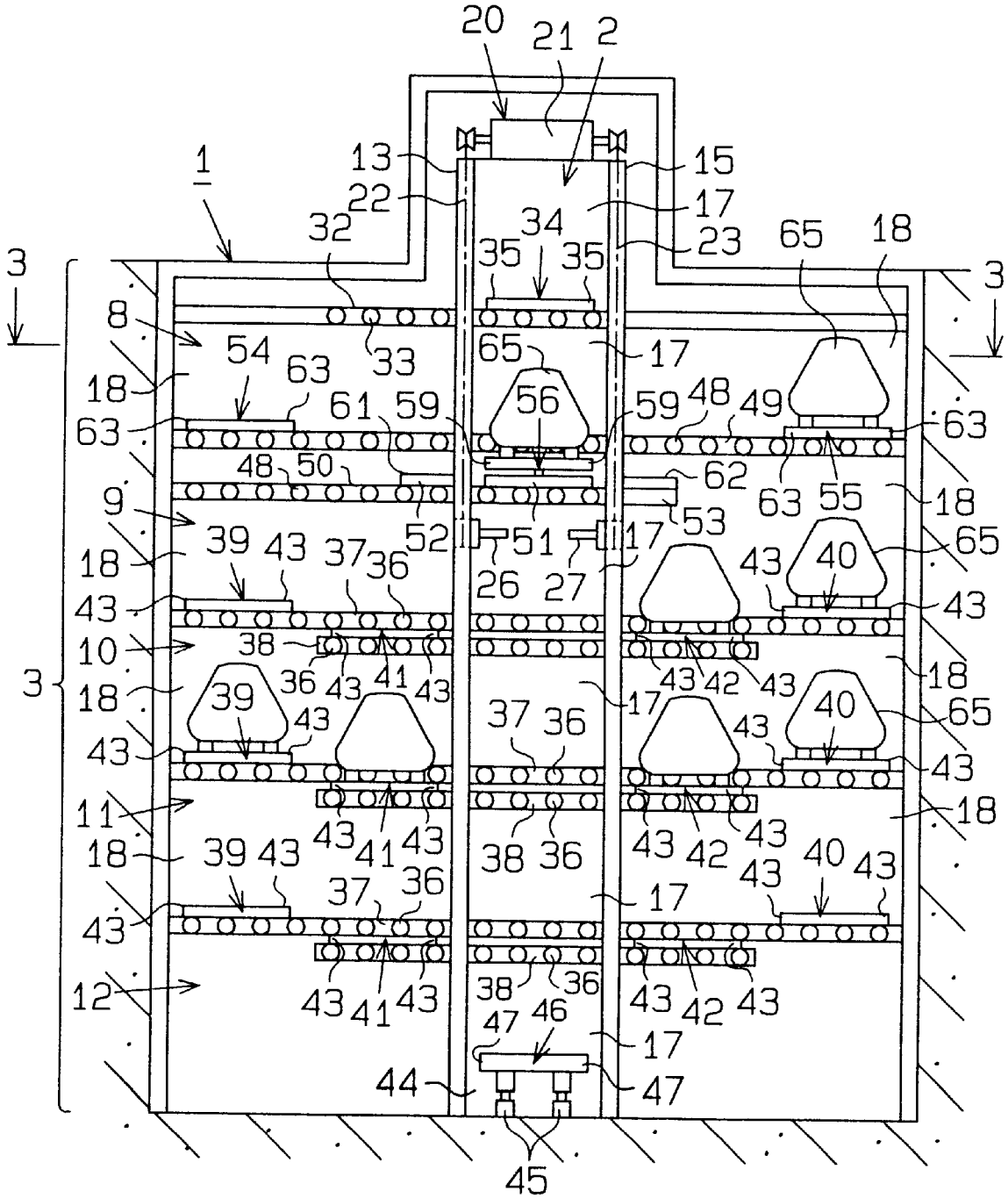
FIG. 2 is a schematic cross-sectional view taken along line 2—2 in FIG. 1.

The second, third, fourth, and fifth 4, 5, 6, 7 storage blocks differ from the first storage block 1, which is shown in FIG. 2, in that the turning area 8 is not provided at basement level one. The structure of basement levels one to four of the second, third, fourth, and fifth storage blocks 4, 5, 6, 7 are substantially the same as the structure of basement levels two to four of the first storage block 1. Thus, the storage blocks 4, 5, 6, 7 are each provided with storing sections 19, elevator shafts 17, and lifts, or elevators 20.

Structure of the Elevators 20

A winch 21 is provided above each elevator shaft 17. The winch 21 is connected to four chains 22, 23, 24, 25 that extend through the guide rails 13, 14, 15, 16, respectively. In addition to the guide rails 13, 14, 15, 16 and the associated chains 22, 23, 24, 25, each elevator 20 includes a pair of lifting platforms 26, 27.

Each lifting platform 26, 27 includes a drive portion 28 and a carrying portion 29. The drive portion 28 of the left platform 26 (as viewed in FIG. 3) includes a support arm 30 connected to the pair of guide rails 13, 14. The drive portion 28 of the right platform 27 (as viewed in FIG. 3) includes a support arm 30 connected to the guide rails 15, 16. The ends of the support arms 30 are supported by the associated guide rails 13, 14, 15, 16 to enable the arms 30 to move vertically. The lower ends of the chains 22, 23, 24, 25 are connected to the associated ends of the support arms 30. Accordingly, the support arms 30 are moved in cooperation with each other by the winch 21. Each carrying portion 29 is defined by comb-like forks 31 that are secured to the support arms 30. The drive portions 28 are lifted and lowered in cooperation with each other through the elevator shaft 17 together with the associated carrying portions 29 when the winch 21 lifts and lowers the chains 22, 23, 24, 25.

The drive source (not shown) of the elevator 20 provided for each storage blocks 4, 5, 6, 7 may be arranged in a corresponding traveling passage 44 at basement level five. In this case, pulleys are provided in the ceiling of basement level one to connect the drive source to the elevator 20 with chains.

Structure of the Entry Station 2

A pair of rails 32 provided with a plurality of rollers 33 extend along the ceiling of the left storing compartment 18 (as viewed in FIG. 2) in the turning area 8 and the floor of the entry station 2. The rails 32 extend horizontally and parallel to each other with a predetermined distance therebetween. A movable tray 34 is movably supported along the rails 32 to carry cars that enter and exit the entry station 2. The rollers 33 move the movable tray 34 into the entry station 2 and out of the entry station 2.

In the same manner as the lifting platforms 26, 27, comb-like carrying portions defined by forks 35 are provided at the left and right sides of the movable tray 34. When the lifting platforms 26, 27 of the elevator 20 are lifted or lowered with the movable tray 34 located in the entry station 2, the forks 31 of the carrying portions 29 of the lifting platforms 26, 27 may be arranged between or moved through the forks 35 of the movable tray 34. Accordingly, storing articles, or cars 65, may be transferred between the forks 35 of the movable tray 34 and the lifting platforms 26, 27 in the entry station 2.

Structure of the Car Storing Sections 9, 10, 11

A pair of upper rails 37 and a pair of lower rails 38, each provided with a plurality of rollers 36, extend along the floor of the storing compartments 18 and into the elevator shaft 17 at basement levels two, three, and four. Each pair of upper rails 37 and lower rails 38 extend horizontally, and the rails of each pair extend parallel to each other with a predetermined distance in between.

Movable trays 39, 40 are movably supported along the upper rails 37 to carry cars between the storing compartments 18 and the elevator shaft 17. Similar movable trays 41, 42 are also movably supported along the lower rails 38. The rotation of the rotors 36 moves the associated trays 39, 40, 41, 42 between the elevator shaft 17 and the storing compartments 18. The plurality of rollers 36 include drive rollers and driven rollers.

Comb-like carrying portions defined by forks 43 are provided at the left and right sides of each movable tray 39, 40, 41, 42. The structure of the forks 43 is identical to the forks 31 of the lifting platforms 26, 27. When the lifting platforms 26, 27 are lifted or lowered with the movable trays 39, 40, 41, 42 located in the elevator shaft 17, the forks 31 of the platforms 26, 27 may be arranged between or moved through the forks 43. Accordingly, cars 65 may be transferred between the forks 43 of the movable trays 39, 40, 41, 42 and the lifting platforms 26, 27 in the elevator shaft 17.

Structure of the Transferring Section 12

A traveling passage 44 is provided at basement level five of each storage block 1, 4, 5, 6, 7 extending through the middle of the transferring section 12. Rails 45 extend continuously along the floor of the traveling passage 44. A carriage 46 is supported on the rails 45.

Carrying portions defined by forks 47 are provided at the left and right sides of the carriage 46. The forks 47 are identical to the forks 31 at the carrying portions 29 of the lifting platforms 26, 27. When the lifting platforms 26, 27 of one of the elevators 20 are lifted or lowered with the carriage 46 located at the associated traveling passage 44, the forks 31 of the platforms 26, 27 may be arranged between or moved through the forks 47 of the carriage 46. Accordingly, cars 65 may be transferred between the forks 47 of the carriage 46 and the lifting platforms 26, 27 in the elevator shafts 17.

Structure of the Turning Area 8

A pair of upper rails 49 provided with a plurality of rollers 48 extend along the floor of the storing compartments 18 and into the elevator shaft 17 at basement level one. A pair of lower rails 50 provided with a plurality of rollers 48 extend along the floor of the left storing compartment 18 (as viewed in FIG. 2) and the into the elevator shaft 17. Each pair of upper rails 49 and lower rails 50 extend horizontally, and the rails of each pair extend parallel to each other with a predetermined distance in between.

A movable center tray 51 and a pair of side trays 52, 53 are supported on the lower rails 50. Movable trays 54, 55 are supported on the upper rails 49. The rotation of the rollers 48 moves the movable center tray 51 between a first position in the elevator shaft 17 (refer to FIG. 3) and a second position in the associated storing compartment 18 (refer to FIG. 4). A turntable 56 is supported on the center tray 51. The turntable 56 is rotatable about a shaft 57. Wheels (not shown) are provided under the turntable and supported on the center tray 51 by an arc-like main rail (not shown).

Figure 3:
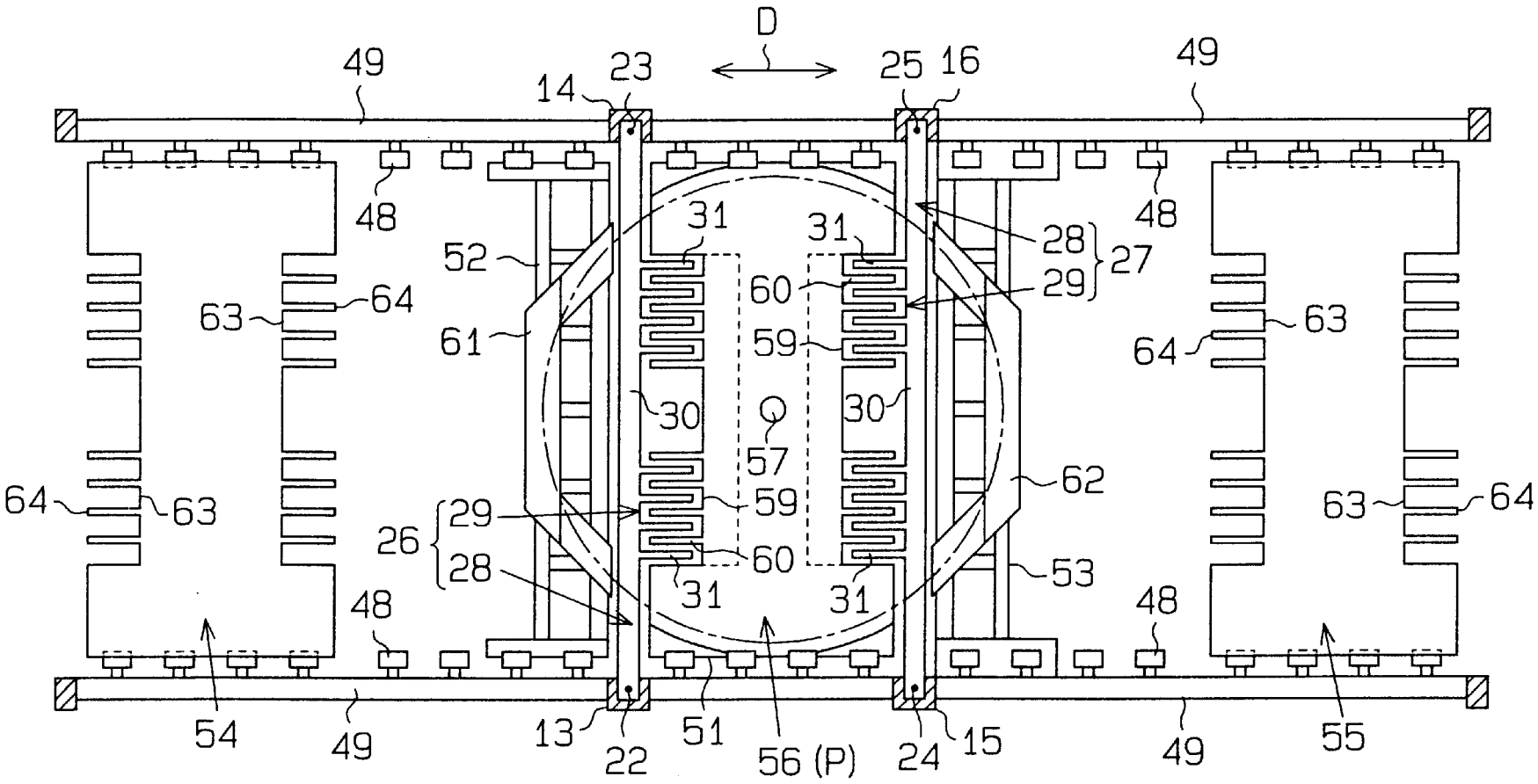
FIG. 3 is a schematic cross-sectional view taken along line 3—3 in FIG. 2 showing the movable center tray, the turntable, the side trays, the auxiliary rails, and the movable storage trays at a predetermined position.
Figure 4:
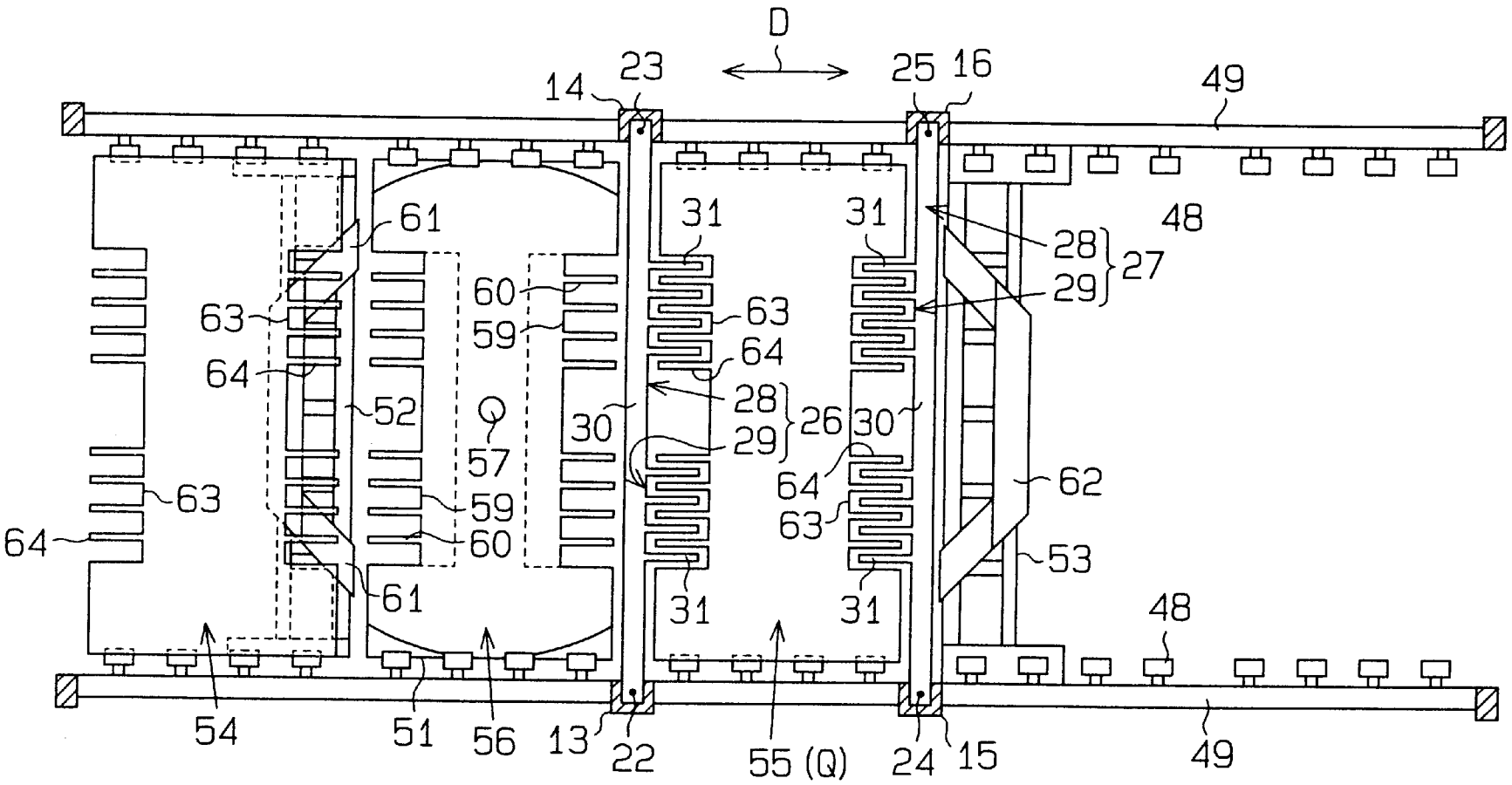
FIG. 4 is a schematic cross-sectional view showing the turntable moved into the turning section from the position shown in FIG. 3.

The turntable 56 has circular ends and carrying portions 59 defined on each side by forks 60. The forks 60 are identical to the forks 31 of the lifting platforms 26, 27. Rotation of the turntable 56 arranges the row of forks 60 on each side of the turntable 56 parallel to the support arms 30, as shown in FIG. 3. When the lifting platforms 26, 27 are lifted or lowered with the center tray 51 located in the elevator shaft 17 at the first position P (refer to FIG. 3), the forks 31 of the platforms 26, 27 may be arranged between or moved through the forks 60 of the turntable 56. Accordingly, cars 65 may be transferred in the elevator shaft 17 between the forks 60 of the turntable 56 and the forks 31 of the lifting platforms 26, 27.

The pair of side trays 52, 53 are provided on each side of the movable center tray 51 and are separated from the center tray 51. The left side tray 52 (as viewed in FIG. 3) is supported on the lower rails 52 and movable in directions D. The right side tray 53 is fixed at a position adjacent to the elevator shaft 17 in the associated storing compartment 18. Arc-like auxiliary rails 61, 62 are provided on the side trays 52, 53 to support the wheels (not shown) of the turntable 56 during rotation of the turntable 56.

The pair of movable trays 54, 55, shown in FIG. 3, are supported on the upper rails 49 and are movable in directions D. Accordingly, the rotation of the rollers 48 moves the movable trays 54, 55 between a position Q (refer to FIG. 4) in the elevator shaft 17 and a position in the associated storing compartments 18 (refer to FIG. 3).

Carrying portions 63 defined by forks 64 are provided on each side of the movable trays 54, 55. The forks 64 are identical to the forks 31 of the lifting platforms 26, 27. When the lifting platforms 26, 27 are lifted or lowered with the movable trays 54, 55 located in the elevator shaft 17 (refer to FIG. 4), the forks 31 of the platforms 26, 27 may be arranged between or moved through the forks 64 of the movable trays 54, 55. Accordingly, cars 65 may be transferred in the elevator shaft 17 between the forks 64 of the movable trays 54, 55 and the forks 31 of the lifting platforms 26, 27.

Figure 5:
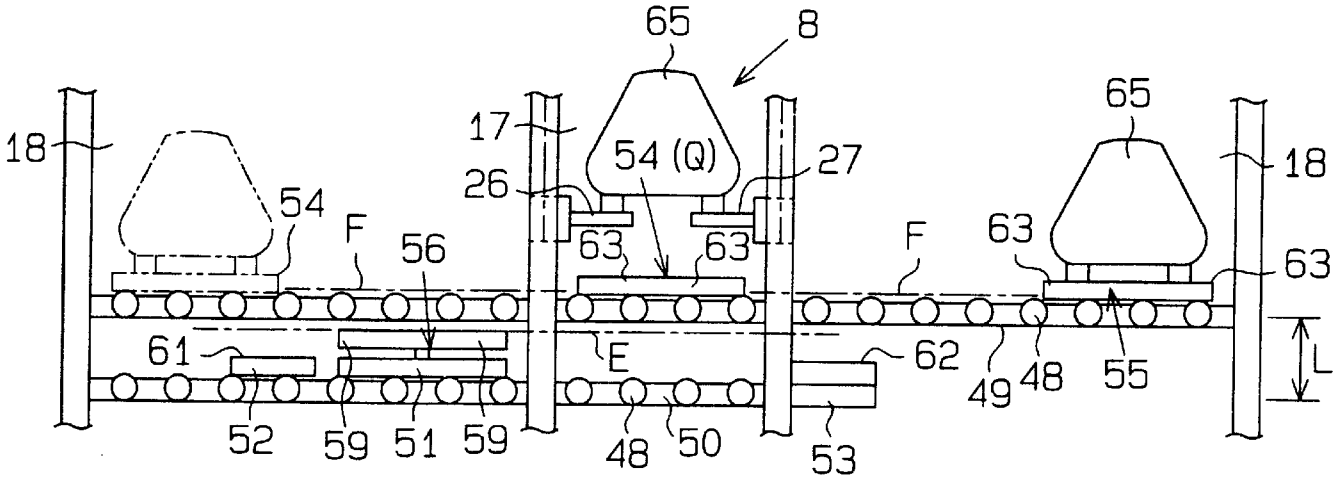
FIGS. 5(*a*) and (*b*) are diagrammatic views showing the movable center tray, the turntable, the side tray, the auxiliary rails, and the movable storage trays located at predetermined positions.
Figure 5:
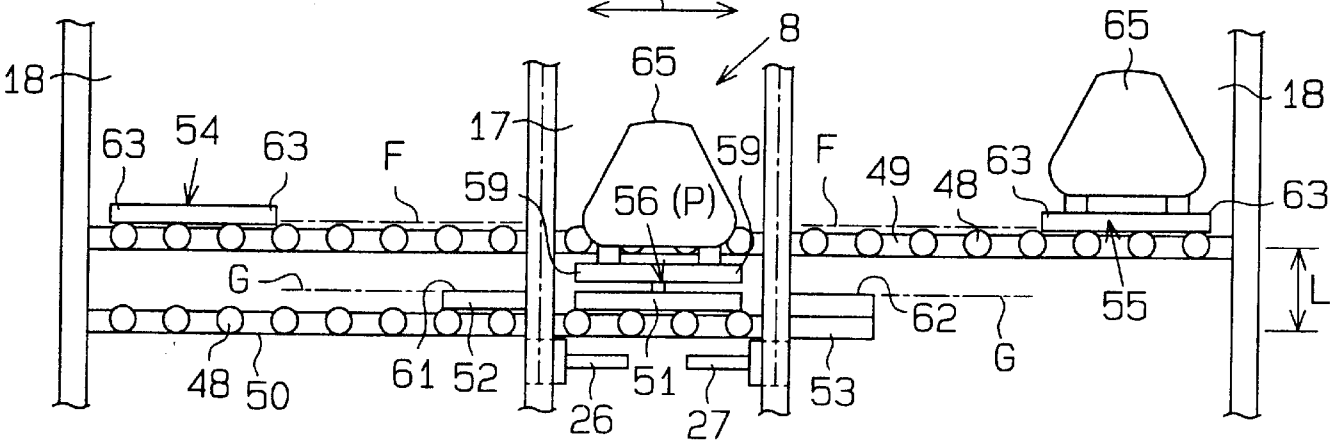
Figure 6:
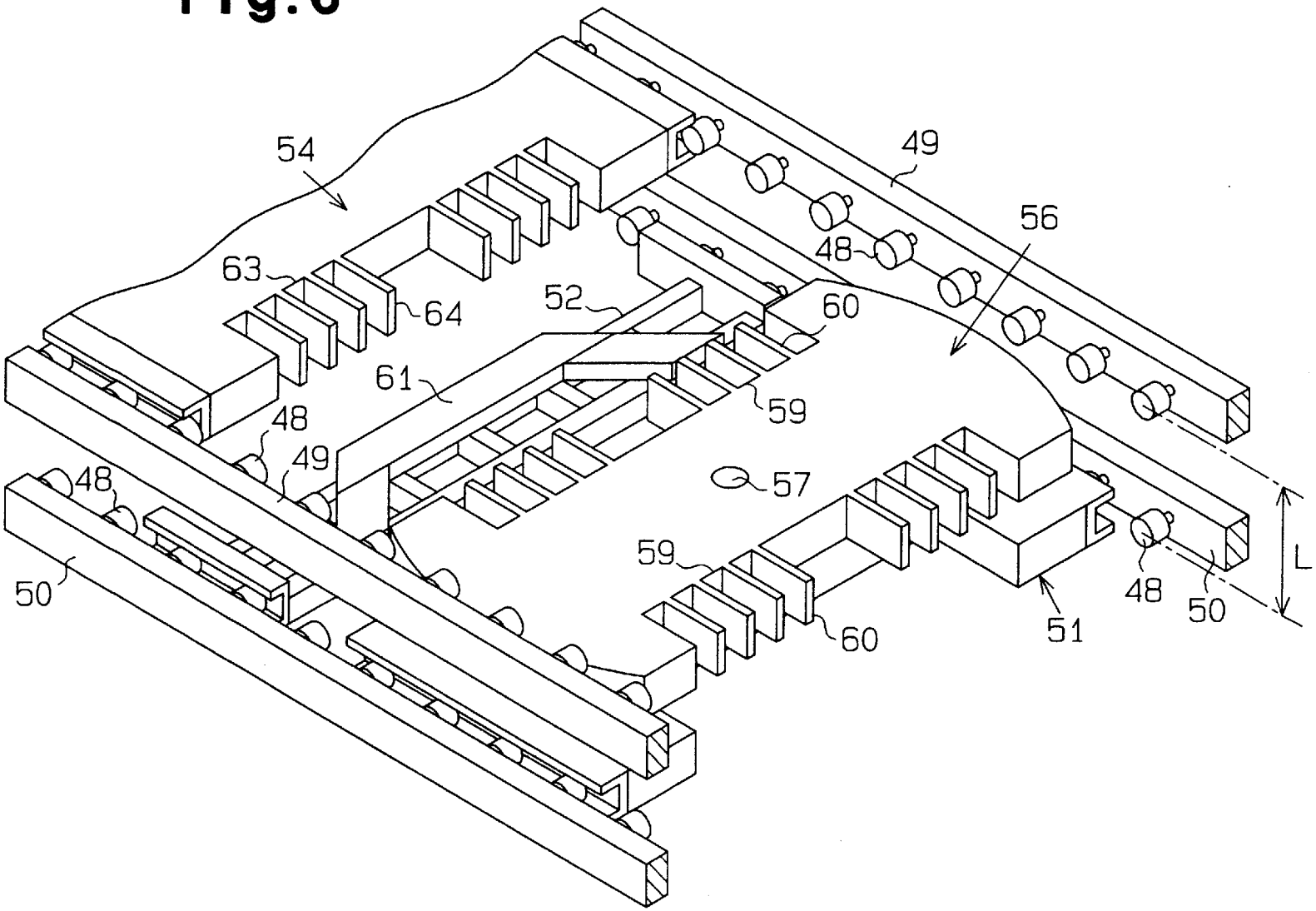
FIG. 6 is a partial perspective view showing the movable center tray, the turntable, the side tray, the auxiliary rails, and the movable storage trays.
Figure 7:
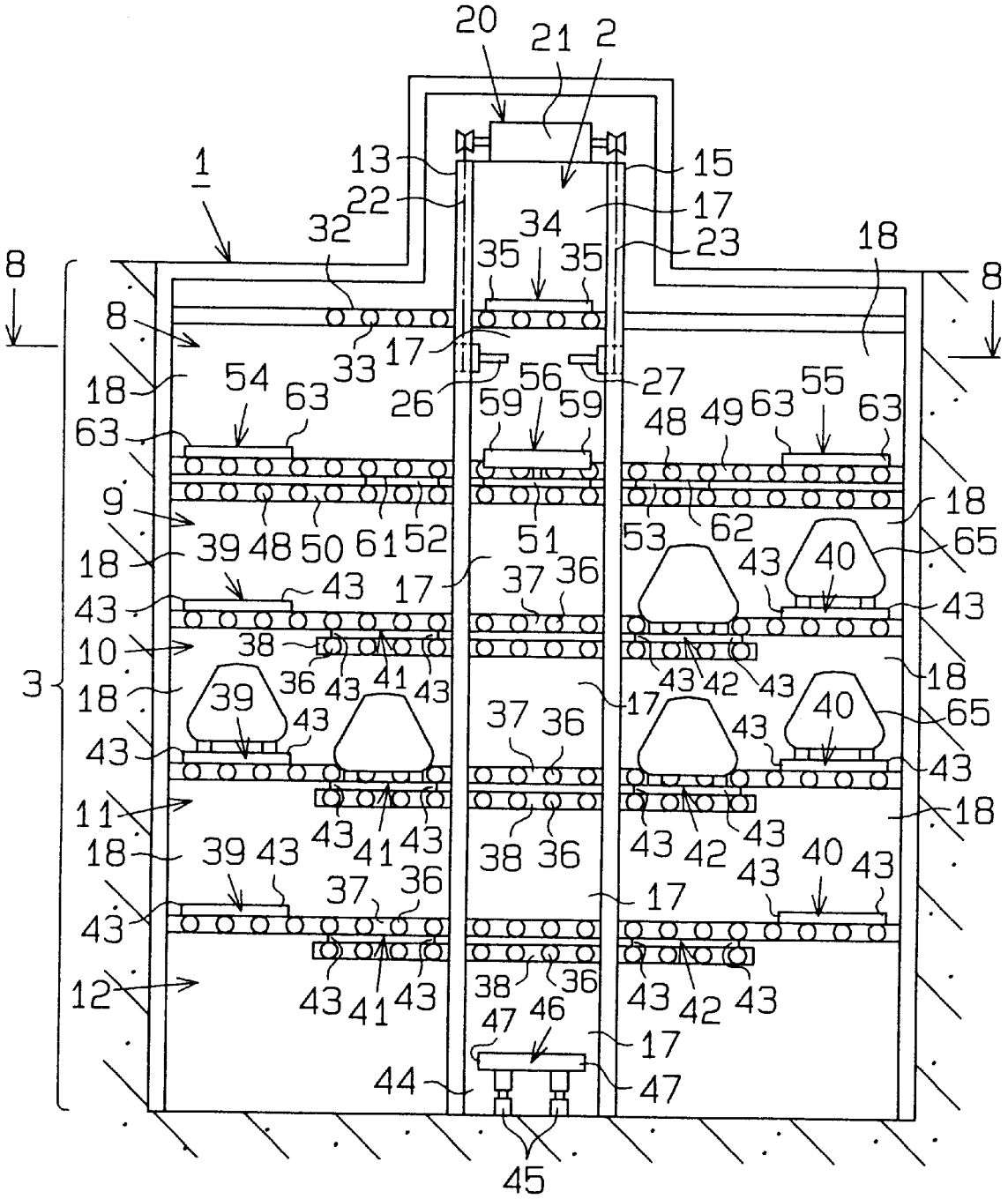
FIG. 7 is a view corresponding to FIG. 2 showing a second embodiment of a parking structure according to the present invention.
Figure 8:
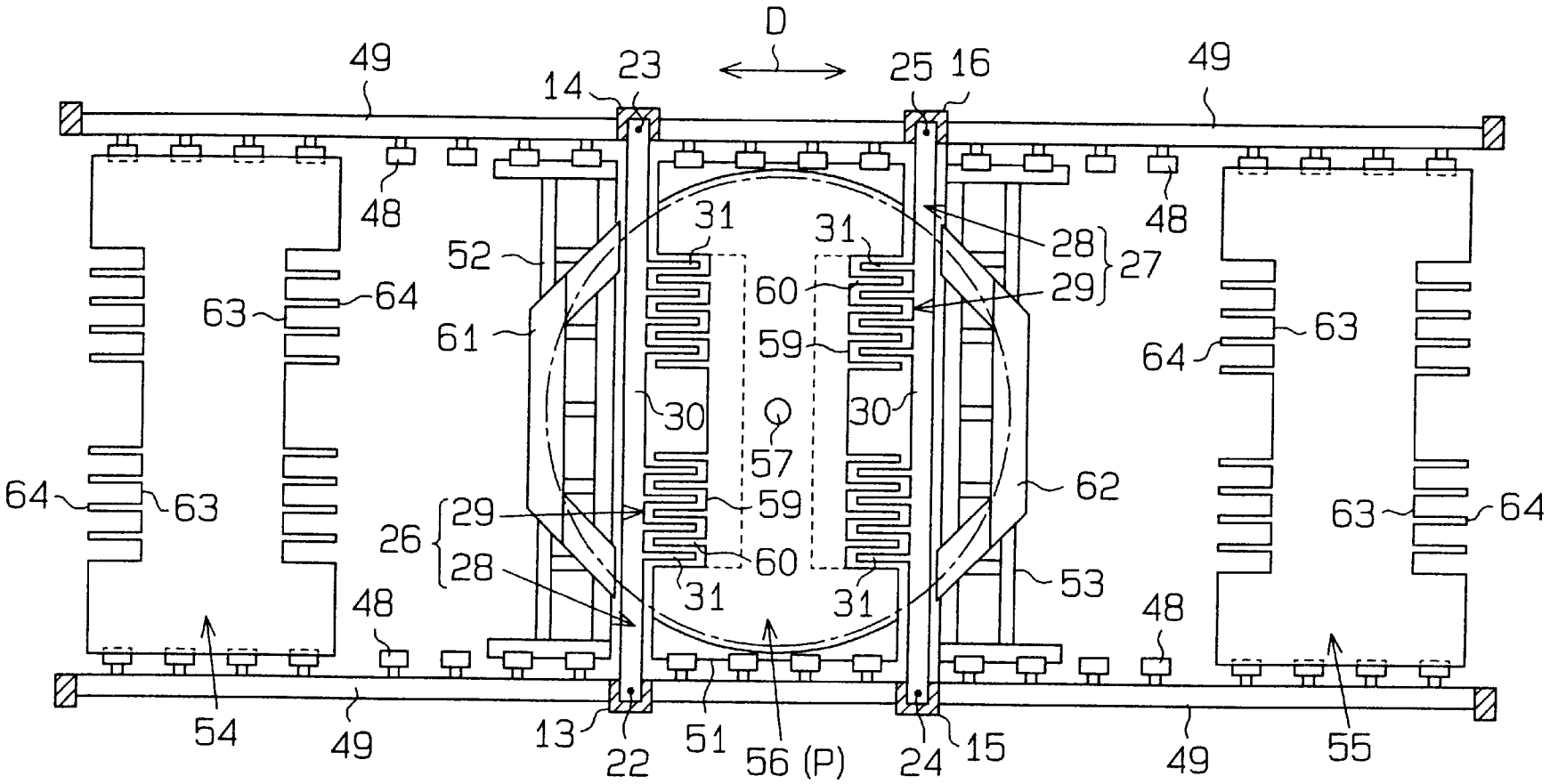
FIG. 8 is a schematic cross-sectional view taken along line 8—8 in FIG. 7 showing the movable center tray, the turntable, the side tray, the auxiliary rails, and the movable storage trays at a predetermined position.
Figure 9:
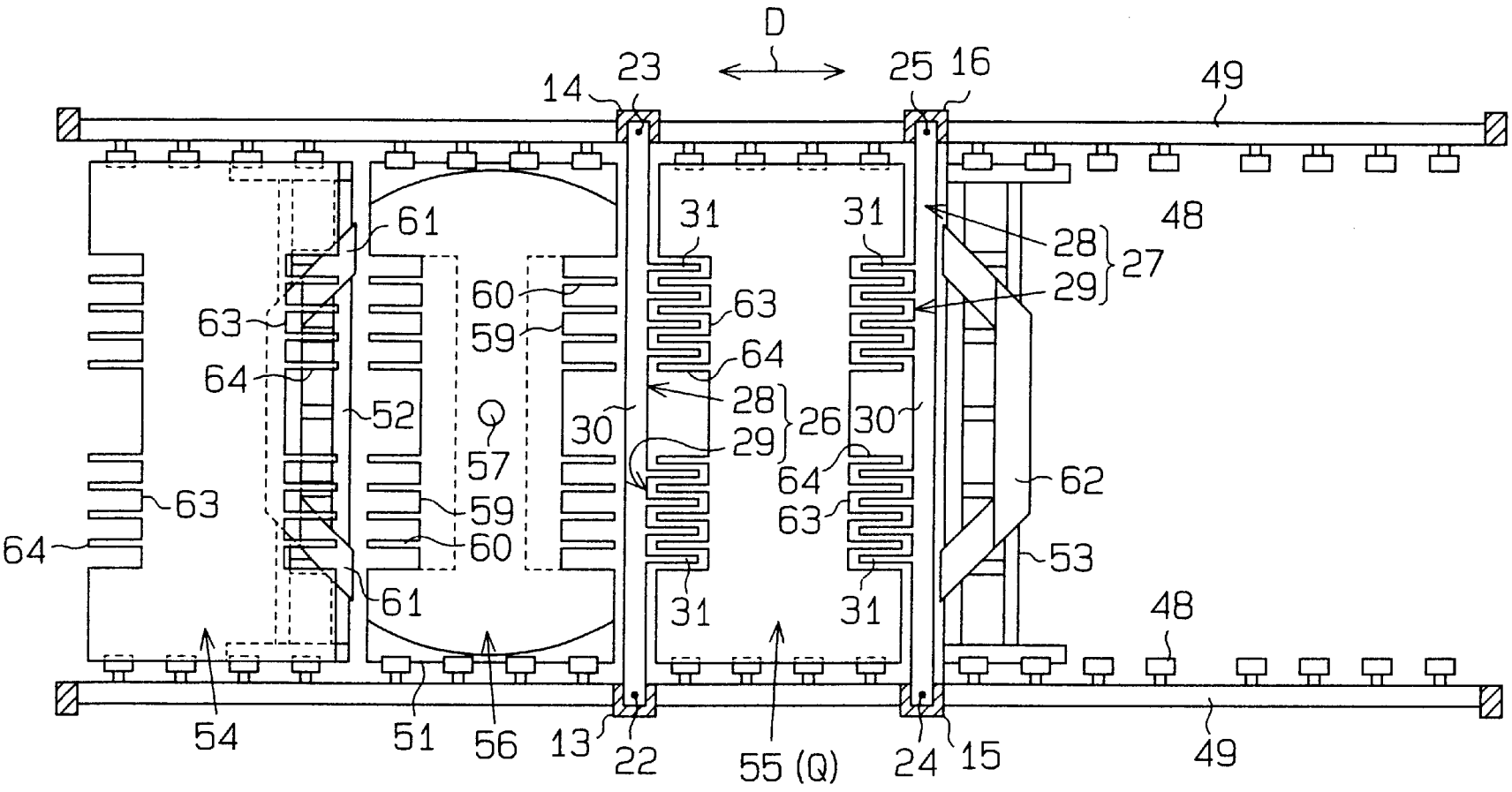
FIG. 9 is a schematic cross-sectional view showing the turntable moved into the turning section from the position shown in FIG. 8.

As shown in FIG. 5(*a*), moving plane E, in which the turntable 56 on the center tray 51 moves, is lower than moving plane F, in which the movable trays 54, 55 move. Accordingly, the movable trays 54, 55 do not collide against the turntable 56 no matter where the turntable 56 is located.

The center tray 51, the side tray 52, and the auxiliary rail 61 are located at positions lower than the moving plane F of the movable trays 54, 55. The fixed side tray 53 and the auxiliary rail 62 are also located at positions lower than the moving plane F of the movable trays 54, 55. Accordingly, the movable trays 54, 55 do not collide against the side trays 52, 53 and the auxiliary rails 61, 62. Furthermore, as shown in FIG. 5(*b*), the wheels (not shown) of the turntable 56 roll along the same plane G on the main rail (not shown) of the center tray 51 and the auxiliary rails 61, 62.

Parking in the Underground Parking Structure

The following steps 1 and 2 are carried out to store a car 65 in the storing compartments 18 of the turning area 8 at basement level 1 of the first storage block 1.

Step 1: Transferring a car 65 from the entry station 2

As shown in FIG. 2, the movable tray 34 is first moved into the entry station 2. The elevator 20 holds the lifting platforms 26, 27 at a position lower than the movable tray 34. A car 65 is moved forward into the entry station 2 and onto the forks 35 of the movable tray 34. The car 65 is then transferred to the lifting platforms 26, 27 from the movable tray 34 by lifting the platforms 26, 27. The movable tray 34 then moves leftward out of the entry station 2. Afterwards, the car 65 held on the lifting platforms 26, 27 is lowered to the turning area 8.

Step 2: Transferring the car 65 in the turning area 8

One of the movable trays 54, 55 (e.g., the left tray 54 as viewed in FIG. 2) is moved into the elevator shaft 17. The car 65 carried on the lifting platforms 26, 27 is lowered to a position above the movable tray 54. In this state, the movable center tray 51, the turntable 56, the movable side tray 52, and the auxiliary rail 61 are moved to positions outside of the elevator shaft 17. As the lifting platforms 26, 27 are lowered, the car 65 is transferred onto the movable tray 54. The movable tray 54 then carries the car 65 leftward out of the elevator shaft 17 and into the associated storing compartment 18 at basement level one. The right movable tray 55 shown in FIG. 2 is operated in the same manner as the left movable tray 54.

The following steps 1 and 2 are carried out to store a car 65 into the storing sections 9, 10, 11 (basement levels two, three, and four).

Step 1: Transferring a car 65 from the entry station 2

A car 65 is transferred from the entry section 2 in the same manner as when moving the car 65 into the turning area 8. The lifting platforms 26, 27 carrying the car 65 are lowered past the turning area 8 and to the designated storing section 9, 10, 11. In this state, the movable center tray 51, the turntable 56, the left side tray 52, and the auxiliary rail 61 are moved to positions outside the elevator shaft 17 at the turning area 8.

Step 2: Transferring the car 65 in the storing sections 9, 10, 11

Among the movable trays 39, 40, 41, 42, the movable tray 39 at basement level two, for example, is moved into the elevator shaft 17. The lifting platforms 26, 27 holding the car 65 are moved to a position above the movable tray 39. The lifting platforms 26, 27 are further lowered to transfer the car 65 onto the movable tray 39. The movable tray 39 carrying the car 65 is moved leftward out of the elevator shaft 17 and into the storing compartment 18. The car 65 is transferred in the same manner when employing the other movable trays 40, 41, 42. However, if a car 65, which has already been stored in one of the storing sections 9, 10, 11, obstructs the storing of the new car 65, the obstructing car 65 is temporarily moved to another level and then returned to its original position after the new car 65 is stored in the designated storing compartment 18.

To store the car 65 in one of the other storage blocks 4, 5, 6, 7 instead of the first storage block 1, the car 65 held on the lifting platforms 26, 27 is first lowered to basement level five in the first storage block 1 and transferred onto the forks 47 of the carriage 46 in the traveling passage 44 of the transferring section 12. The carriage 46 carries the car 65 through the transferring sections 12 (basement level five) of the other storage blocks 4, 5, 6, 7. When the carriage 46 reaches the designated storage blocks 4, 5, 6, 7, the car 65 is transferred to the lifting platforms 26, 27 of the associated elevator 20. The car 65 is then lifted and stored in the designated storing compartment 18.

The following steps 1 to 3 are performed when retrieving a car 65 from the storing compartment 18 of the turning area 8 located at basement level one of the first storage block 1.

Step 1: Rotating a car 65 in the turning area 8

Among the movable trays 54, 55, for example, the left movable tray 54 carrying a car 65 is moved into the elevator shaft 17. In this state, the movable center tray 51, the turntable 56, the left side tray 52 and the auxiliary rail 61 are moved to positions outside the elevator shaft 17. The lifting platforms 26, 27 of the elevator 20 are located at a position lower than the movable tray 54. When the lifting platforms 26, 27 are lifted, the car 65 is transferred to the lifting platforms 26, 27 from the movable tray 54. Afterwards, the movable tray 54 is moved out of the elevator shaft 17.

The movable center tray 51, the turntable 56, the side tray 52, and the auxiliary rail 61 are then moved into the elevator shaft 17. This arranges the movable auxiliary rail 61 and the fixed auxiliary rail 62 on each side of the turntable 56. When the lifting platforms 26, 27 carrying the car 65 are lowered, the car 65 is transferred onto the turntable 56.

The turntable 56 carrying the car 65 is rotated 180 degrees along the main rail (not shown) of the movable center tray 51 and the auxiliary rails 61, 62 of the associated side trays 52, 53. This turns the car 65 by 180 degrees from the position of the car 65 when it entered the parking structure.

Step 2: Transferring the car 65 from the turning area 8

The lifting platforms 26, 27 of the elevator 20 are held at a position lower than the turntable 56, which is carrying the car 65. The lifting platforms 26, 27 are then lifted to receive the car 65 from the turntable 56. The lifting platforms 26, 27 carrying the car 65 are then lifted to the entry station 2. The right movable tray 55 is employed in the same manner as the left movable tray 54.

Step 3: Transferring the car 65 to the entry station 2

The movable tray 34 is moved out of the entry station 2 before the lifting platforms 26, 27 carrying the car 65 are lifted into the entry station 2. When the car 65 is lifted into the entry station 2, the lifting platforms 26, 27 are located above the movable tray 34. The movable tray 34 then moves into the entry station 2 and the lifting platforms 26, 27 are lowered to transfer the car 65 onto the movable tray 34. The car 65 is then driven forward on the movable tray 34 and out of the entry station 2.

The following steps 1 to 3 are performed when retrieving a car 65 from the storing sections 9, 10, 11 of the associated basement levels two to four of the first storage block 1.

Step 1: Transferring a car 65 from the storing sections 9, 10, 11

The movable tray 39 in the storing section 9, like the other similar trays 40, 41, 42 in the storing section 10, 11, is moved into the elevator shaft 17 with a car 65 held thereon. The lifting platforms 26, 27 of the elevator 20 are previously arranged at a position lower than the movable tray 39. The lifting platforms 26, 27 are then lifted to receive the car 65 from the movable tray 65.

Step 2: Turning the car 65 in the turning area 8

The lifting platforms 26, 27 carrying the car 65 are lifted into the turning area 8 while the movable center tray 51, the turntable 56, the side tray 52 and the auxiliary rail 61 are located outside the elevator shaft 17. Afterwards, the car 65 is rotated by 180 degrees from its position when entering the parking structure. The turning of the car 65 is carried out in the same manner as when retrieving the car 65 from the storing compartments 18 of the turning area 8, which was described earlier.

Step 3: The transferring of the car 65 from the turning area 8 and from the entry station 1 are carried out in the same manner as when retrieving the car 65 from the storing compartments 18 of the turning area 8.

To retrieve a car 65 from the second, third, fourth and fifth storage blocks 4, 5, 6, 7, the car 65 is first transferred onto the lifting platforms 26, 27 of the associated storage block 4, 5, 6, 7. The lifting platforms 26, 27 are then lowered into the traveling passage 44 at the transferring section 12 (basement level five) to transfer the car 65 onto the forks 47 of the carriage 46. At basement level five, the carriage 46 moves the car 65 past the storage blocks 4-7 and to the traveling passage 44 in the transferring section 12 of the first storage block 1. The car 65 is then transferred onto the lifting platforms 26, 27 of the first storage block 1 from the carriage 46. Afterwards, the car 65 is transferred to the turning area 8 and rotated by 180 degrees with respect to the position of the car 65 when it entered the parking structure. The turning of the car 65 is carried out in the same manner as when retrieving the car 65 from the storing compartments 18 of the turning area 8. The rotated car 65 is then moved out of the parking structure from the entry station 2.

The first embodiment has the following features.

The turning area 8 including the elevator shaft 17 is provided at a location other than the entry station 2. In the turning area 8, the turntable 56 is rotatably coupled to the movable center tray 51. The rotation of the turntable 56 arranges the turntable 56 to position P. Cars 65 are transferred between the carrying portion 59 of the turntable 56 and the lifting platforms 26, 27 of the elevator 20 in the elevator shaft 17. The turntable 56, functioning as a turning apparatus for cars 65, is arranged outside the entry station 2. Thus, space for accommodating the turntable 56 when it is moved out of the elevator shaft 17 need not be provided in the entry station 2. This saves space necessary for the entry station 2, which is exposed above the ground.

In the turning area 8, the movable center tray 51 may be moved into and out of the elevator shaft 17. This allows the lifting platforms 26, 27, which carry the car 65, to move through the elevator shaft 17. Accordingly, a car 65 may be carried smoothly between the entry station 2 and the storing compartments 18.

The auxiliary rails 61, 62 that support the turntable 56 during rotation of the turntable 56 are provided on the side trays 52, 53, respectively, and on each side of the movable center tray 51. This enables stable rotation of the turntable 56 when carrying the car 65.

The turning area 8, the elevator shaft 17, and the storing compartments 18 are provided at a location separate from the location of the entry station 2. The movable trays 54, 55 are provided in the turning area 8 and are movable in the same moving directions D as the movable center tray 51. This enables the movable trays 54, 55 to be moved between the elevator shaft 17 and the storage compartments 18. The carrying portions 63 of the movable trays 54, 55 may be moved to position Q at which a car 65 is transferred between movable trays 54, 55 and the lifting platforms 26, 27 of the elevator 20 in the elevator shaft 17. The structure of the turning area 8 enables the cars 65 to be stored therein. This improves the storing efficiency of the parking structure.

The side trays 52, 53 and the auxiliary rails 61, 62 move relatively to the movable center tray 51 and the turntable 56 in a plane lower than the movable trays 54, 55. Thus, as shown in FIG. 5(*a*), the movable tables 54, 55 may be moved between the elevator shaft 17 and the associated storing compartments 18 without colliding against the turntable 56. Accordingly, the cars 65 may be moved smoothly on the movable tables 54, 55.

When retaining cars 65 from the parking structure, the movable center tray 51, the turntable 56, the side tray 52, and the auxiliary rail 61 are moved to a position shown in FIG. 5(*b*). At this position, the turntable 56, which carries a car 65, is rotated supported by the movable center tray 51 and the auxiliary rails 61, 62 of the associated side trays 52, 53. This enables the car 65 to be smoothly turned around in the turning area 8.

As described above, the movable trays 54, 55 are moved between the elevator shaft 17 and the associated storage compartments 18 without colliding against the turntable 56 regardless of where the turntable 56 is located. In other words, the turntable 56 need not be moved to avoid collision with the movable trays 54, 55 when moving the movable trays 54, 55. Thus, among the two side trays 52, 53 arranged on each side of the movable center tray 51, the position of the side tray 53 may be fixed. Accordingly, a driving mechanism for the side tray 53 need not be provided.

Among the two side trays 52, 53 arranged on each side of the movable center tray 51, the left side tray 52 is movable in the same moving directions D as the movable center tray 51. This enables smooth movement of the movable center tray 51.

The turning area 8 is provided adjacent to the entry station 2. Thus, car storing sections are not provided between the turning area 8 and the entry station 2. This allows the cars 65 to be carried into the turning area 8 and then transferred to the entry station 2 as soon as the car 65 is turned around. Accordingly, the car 65 may be turned around efficiently when retrieving the car 65 from the parking structure.

A second embodiment of a parking structure according to the present invention will now be described with reference to FIG. 1 and FIGS. 7 to 11. FIGS. 1, 2, 3, 4, 5(*a*), 5(*b*), and 6 illustrating the first embodiment correspond to FIGS. 1, 7, 8, 9, 10(*a*), 10(*b*), and 11 illustrating the second embodiment.

Figure 10A:
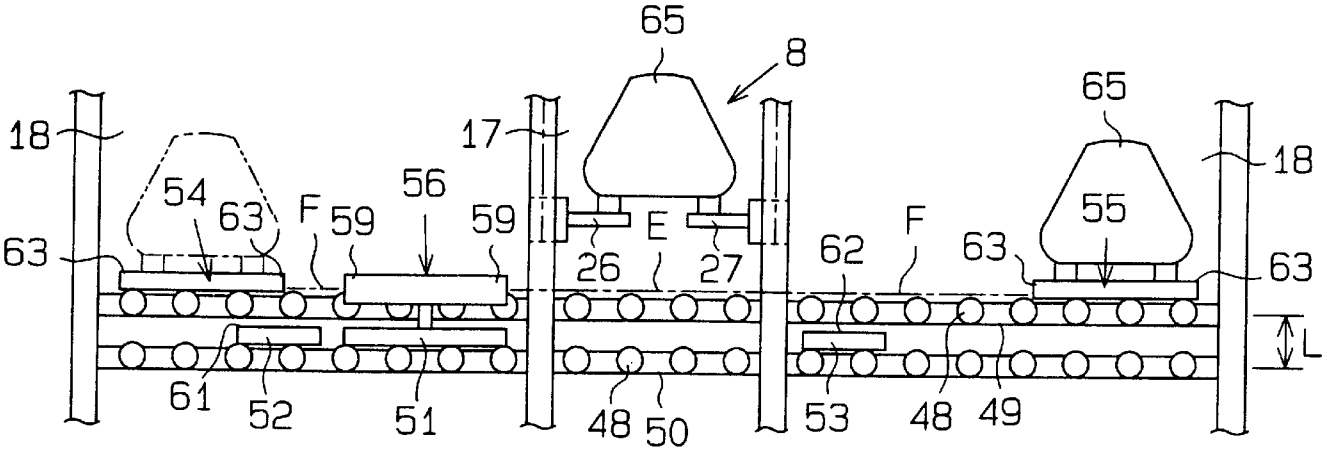
FIGS. 10(*a*) and (*b*) are diagrammatic views showing the movable center tray, the turntable, the side tray, the auxiliary rails, and the movable storage trays located at predetermined positions.
Figure 10B:
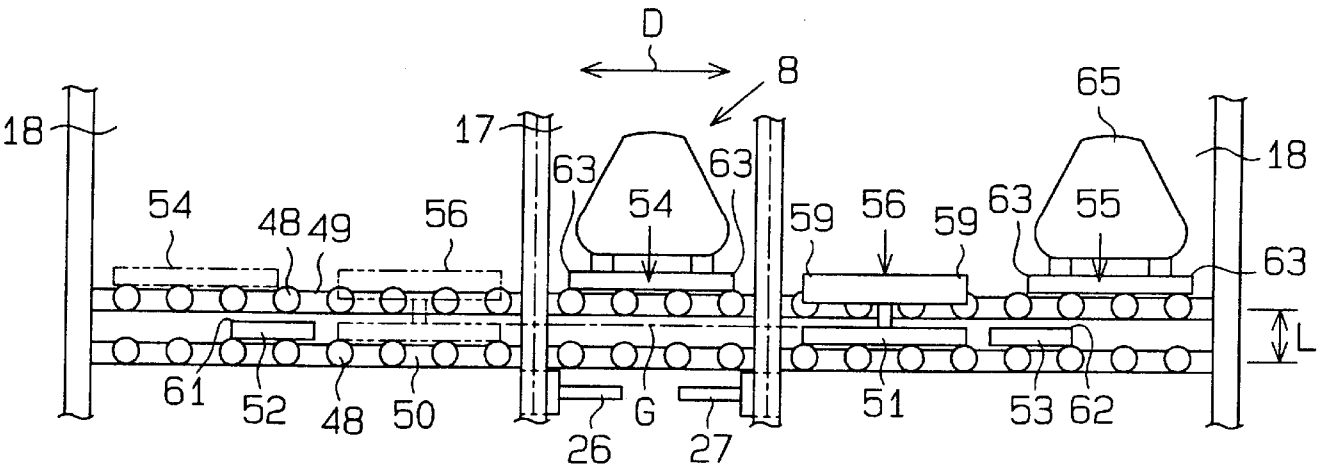
Figure 11:
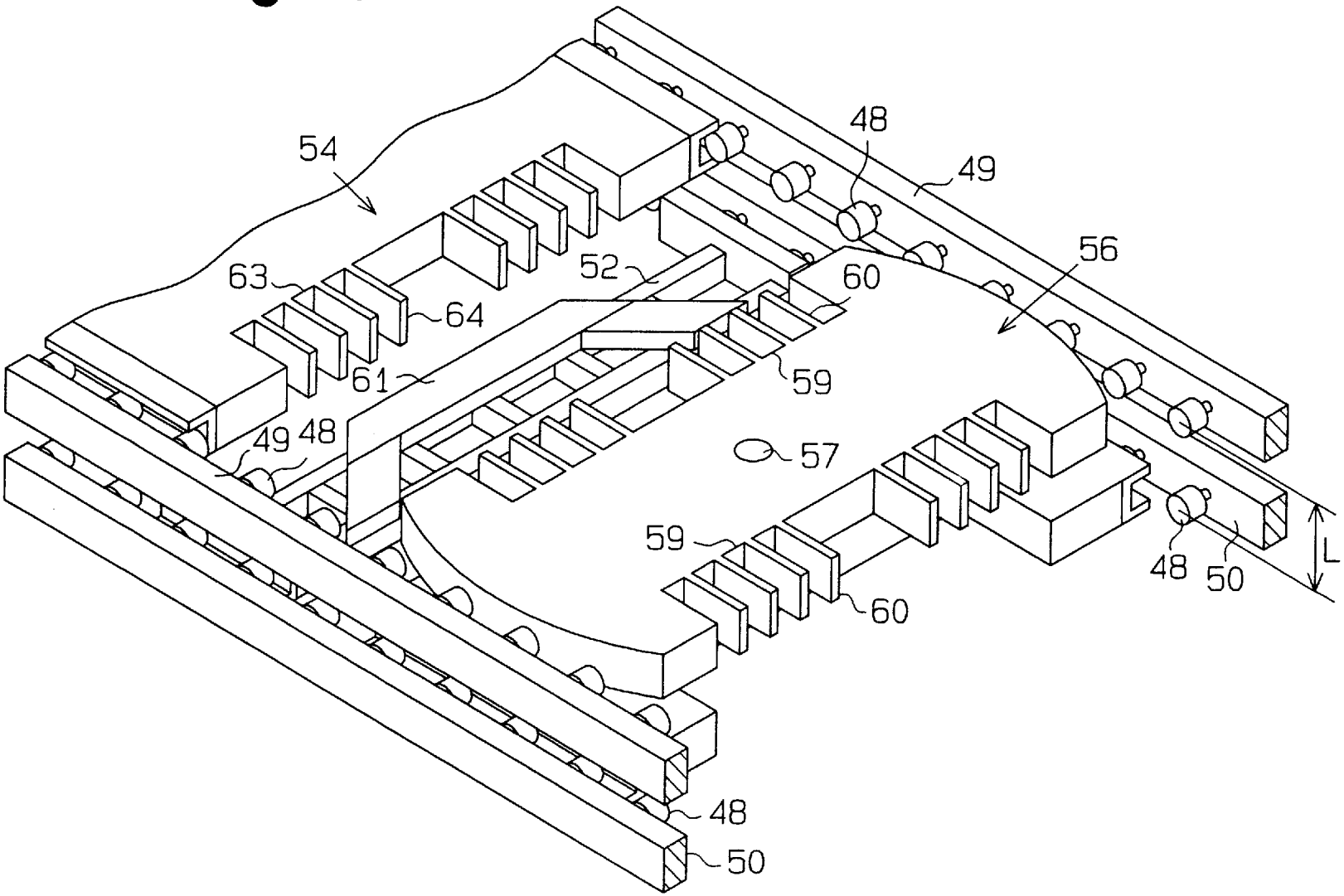
FIG. 11 is a partial perspective view showing the movable center tray, the turntable, the side tray, the auxiliary rails, and the movable storage trays of FIG. 10.

The features of the second embodiment that differ from that of the first embodiment will now be described. The distance L between the upper rails 49 and the lower rails 50 of the first embodiment, as shown in FIGS. 5(*a*), 5(*b*), and 6 is greater than the distance L between the upper rails 49 and the lower rails 50 of the second embodiment, as shown in FIGS. 10(*a*), 10(*b*), and 11. Thus, in the first embodiment, this enables the turntable 56 in addition to the movable center tray 51, the side trays 52, 53, and the auxiliary rails 61, 62 to be arranged at a position lower than the moving plane F of the movable trays 54, 55. In comparison, the moving plane E of the turntable 56 in the second embodiment coincides with the moving plane F of the movable trays 54, 55.

In the second embodiment, the pair of side trays 52, 53 supporting associated auxiliary rails 61, 62 are movable in the same moving directions D as the movable center tray 51. In the first embodiment, only the left side tray 52 is movable. The position of the right side tray 53 is fixed.

As shown in FIGS. 10(*a*) and 10(*b*), to avoid collision between the movable trays 54, 55 and the turntable 56 when moving the movable trays 54, 55 between the elevator shaft 17 and the associated storing compartments 18, the movable center tray 51 and the turntable 56 are moved together with the movable trays 54, 55. The side trays 52, 53 and the auxiliary rails 61, 62 are also moved to allow movement of the movable center tray 51.

Although only two embodiments of the present invention have been described so far, it should be apparent to those skilled in the art that the present invention may be embodied in many other specific forms without departing from the spirit or scope of the invention. Particularly, it should be understood that the invention may be embodied in the following forms.

The turning area 8 need not be provided with the storing compartments 18 and may be used exclusively to accommodate the turntable 5 when the turntable is moved out of the elevator shaft 17.

The side trays 52, 53 may be formed integrally with the movable center tray 51 at each side of the center tray 51. This structure moves the movable center tray 51 together with the side trays 52, 53.

A plurality of turning areas 8 may be provided. For example, in addition to the turning area 8 at basement level one in the first storage block 1, a similar turning section may be provided in any one of the storing sections 9, 10, 11 below basement level one.

The storage blocks need not be constructed underground but may be constructed above the ground.

The storing articles are not limited to cars 65. For example, the storing articles may be boxes or crates.

Platforms having forks are used to transfer the cars 65. However, pallets and prongs used to hold the pallets may be employed in the elevator 20. In this case, the pallet and the car 65 carried thereon correspond to the storing article. The car 65 is lifted and lowered by the prongs of the elevator 20 that hold the pallet. The storing article is transferred between the prongs of the elevator 20 and the turntable 56 or the movable tables 54, 55.

Therefore, the present examples and embodiments are to be considered as illustrative and not restrictive and the invention is not to be limited to the details given herein, but may be modified within the scope of the appended claims.

What is claimed is:

1. A storage structure for storing articles comprising:

a frame;

an entry station for receiving articles;

a storage area defined by members of the frame for storing the articles;

a lift passage located within the frame for connecting the entry station and the storage area, wherein the entry station is in the lift passage;

a lift for conveying the articles through the lift passage between the entry station and the storage area;

a turning station located apart from the entry station within the frame, the turning station being connected to the lift passage for changing the orientation of an article; and a turntable device supported in the turning station by the frame for receiving one of the articles from the lift within the lift passage and for transferring one of the articles to the lift, wherein the turntable device includes a rotatable carrying surface and two auxiliary supports, one auxiliary support being located on each of two opposite sides of the turntable device for supporting the carrying surface when the carrying surface rotates, wherein the carrying surface is movable between a position within the lift passage and a position outside of the lift passage.

2. The storage structure according to claim 1, wherein the lift has an article engaging portion that ascends and descends within the lift passage while holding one of the articles, wherein the carrying surface receives articles from the article engaging portion of the lift so that the articles are transferred from the lift to the turntable device within the lift passage.

3. The storage structure according to claim 1, wherein one of the auxiliary supports is movable horizontally relative to the other auxiliary support.

4. The storage structure according to claim 1, wherein the turning station has an article storage station connected to the lift passage for storing one of the articles, the turning station further having at least one movable tray for moving along horizontal members of the frame, wherein the movable tray has an article engaging portion for receiving an article, wherein the movable tray is movable in the same directions as the carrying surface and is selectively movable to a position within the lift passage and to a position outside of the lift passage, and wherein the article engaging portion of the movable tray receives articles from the article engaging portion of the lift within the lift passage.

5. The storage structure according to claim 4, wherein one of the auxiliary supports is separable and movable relative to the remainder of the turntable device.

6. The storage structure according to claim 1, wherein a first one of the auxiliary supports is movable with the carrying surface, and a second one of the auxiliary supports is fixed.

7. The storage structure according to claim 6, wherein the carrying surface, a first one of the auxiliary supports, and a second one of the auxiliary support are each separate, the first auxiliary support being separable from and movable relative to the carrying surface.

8. The storage structure according to claim 1, wherein auxiliary supports are movable in the same directions that the carrying surface moves in.

9. The storage structure according to claim 1, wherein the carrying surface, a first one of the auxiliary supports, and a second one of the auxiliary supports are each separate and movable relative to each other.

10. The storage structure according to claim 1, wherein the turning station is located adjacent to the entry station.

11. A storage structure for storing articles comprising:

an entry and exit station for receiving the articles and for delivering the articles after the articles have been stored;

a storage area including a plurality of storage stations for storing the articles, each storage station defined by horizontal frame members and vertical frame members;

a lift passage located between the entry and exit station and the storage area;

a lift moving through the lift passage within the frame to convey the articles between the entry and exit station and the storage area;

a movable tray movably located on the first horizontal frame members, the movable tray moving one of the articles to and from one of the storage stations in a path;

a turning area including a part of the lift passage and one of the storage stations, and located apart from the entry and exit station, the turning area having a horizontal guide rail positioned below one of the horizontal frame members; and a turntable device located between one of the horizontal frame members and the horizontal guide rail in the turning area for reorienting the article, the turntable device being movable horizontally along the horizontal guide rail in a path, wherein the path of the turntable device is parallel to and spaced from the path of the movable tray.

12. The storage structure according to claim 11, wherein at least one of the auxiliary supports is movable with the carrying surface.

13. The storage structure according to claim 11, wherein one of an auxiliary support is movable in the same directions that the carrying surface moves in, and the other auxiliary support is fixed.

14. The storage structure according to claim 11, wherein the carrying surface and each of an auxiliary support are separate from one another, and wherein one of the auxiliary supports is movable relative to the carrying surface.

15. The storage structure of claim 11, wherein the turntable device includes a rotatable carrying surface and two auxiliary supports, the rotatable carrying surface being movable horizontally in the turning area without interfering with the movable tray, one auxiliary support being located on each of two opposite sides of the turntable device for supporting the carrying surface when the carrying surface rotates.

16. The storage structure according to claim 15, wherein the auxiliary supports are movable in the same directions that the carrying surface moves in.

17. A storage structure for storing articles comprising:

a frame;

an entry station for receiving articles;

a storage area located within the frame for storing the articles, wherein articles in the storage area are supported by the frame;

a lift passage defined by vertical members of the frame for connecting the entry station and the storage area;

a lift for conveying the articles through the lift passage between the entry station and the storage area;

a turning area located within the frame and apart from the entry station, the turning area being connected to the lift passage for changing the orientation of an article, wherein the turning station includes a storage station connected to the lift passage for storing an article;

a turntable device supported in the turning station for receiving one of the articles from the lift within the lift passage, wherein the turntable device has a rotatable carrying surface for receiving one of the articles, and wherein the carrying surface is movable in a first horizontal plane between a position within the lift passage and a position outside of the lift passage; and at least one movable tray located in the turning station, each movable tray moving along the horizontal frames and having an article engaging surface for engaging one of the articles, each movable tray being movable in a second horizontal plane, which is parallel to, spaced from, and above the first horizontal plane so that the movable tray and the turntable device do not interfere with one another, the movable tray being selectively moved to a position within the lift passage and a position outside of the lift passage, wherein the article engaging surface of the movable tray receives one of the articles from the lift within the lift passage.

18. The article storage structure according to claim 17, wherein the turntable device is comprised of at least two separate cooperating segments, wherein at least one of the segments moves horizontally within the first horizontal plane, and wherein the movable segment includes the carrying surface.

19. The article storage structure according to claim 17, wherein the turning station is immediately below the entry station.

20. The article storage structure according to claim 17, wherein auxiliary supports are always positioned outside of the lift passage.

* * * * *